United States Patent [19]

Davis

[11] Patent Number: 4,717,909

[45] Date of Patent: Jan. 5, 1988

[54] INDICATOR SYSTEM FOR A DOOR WITH SLIDING BOLT LOCK

[76] Inventor: Jack D. Davis, 4452 Scenic Dr., Eugene, Oreg. 97404

[21] Appl. No.: 768,799

[22] Filed: Aug. 23, 1985

[51] Int. Cl.[4] ..... G08B 21/00; H01H 27/06

[52] U.S. Cl. ..... 340/686; 200/61.68

[58] Field of Search ..... 340/542, 540, 686; 200/61.67, 61.68; 70/DIG. 49, 432, 438, 441

[56] References Cited

U.S. PATENT DOCUMENTS

| | | | |
|---|---|---|---|
| 1,723,956 | 8/1929 | Schuerman | 200/61.68 |
| 2,301,290 | 11/1942 | Knight | 200/61.68 |
| 3,866,164 | 2/1975 | Peterson | 340/542 X |
| 4,360,803 | 11/1982 | Heiland | 340/542 |
| 4,465,997 | 8/1984 | Hines | 200/61.68 X |

FOREIGN PATENT DOCUMENTS

| | | | |
|---|---|---|---|
| 432462 | 6/1933 | United Kingdom | 340/542 |

*Primary Examiner*—Swann, III: Glen R.
*Assistant Examiner*—Thomas J. Mullen, Jr.
*Attorney, Agent, or Firm*—James D. Givnan, Jr.

[57] ABSTRACT

A housing is mounted interiorly of a door frame member and houses first and second switch members which move simultaneously in response to entry of a lock bolt end into a strike plate opening. A switch on the housing is in circuit with an indicating unit having illuminated door open and door locked signals and a power source. The first and second switch members are in sliding contact with one another and are displaced laterally away from the lock bolt as it moves to a door locking position. A projection on the first switch member is normally disposed in the strike plate opener.

8 Claims, 3 Drawing Figures

FIG. 1
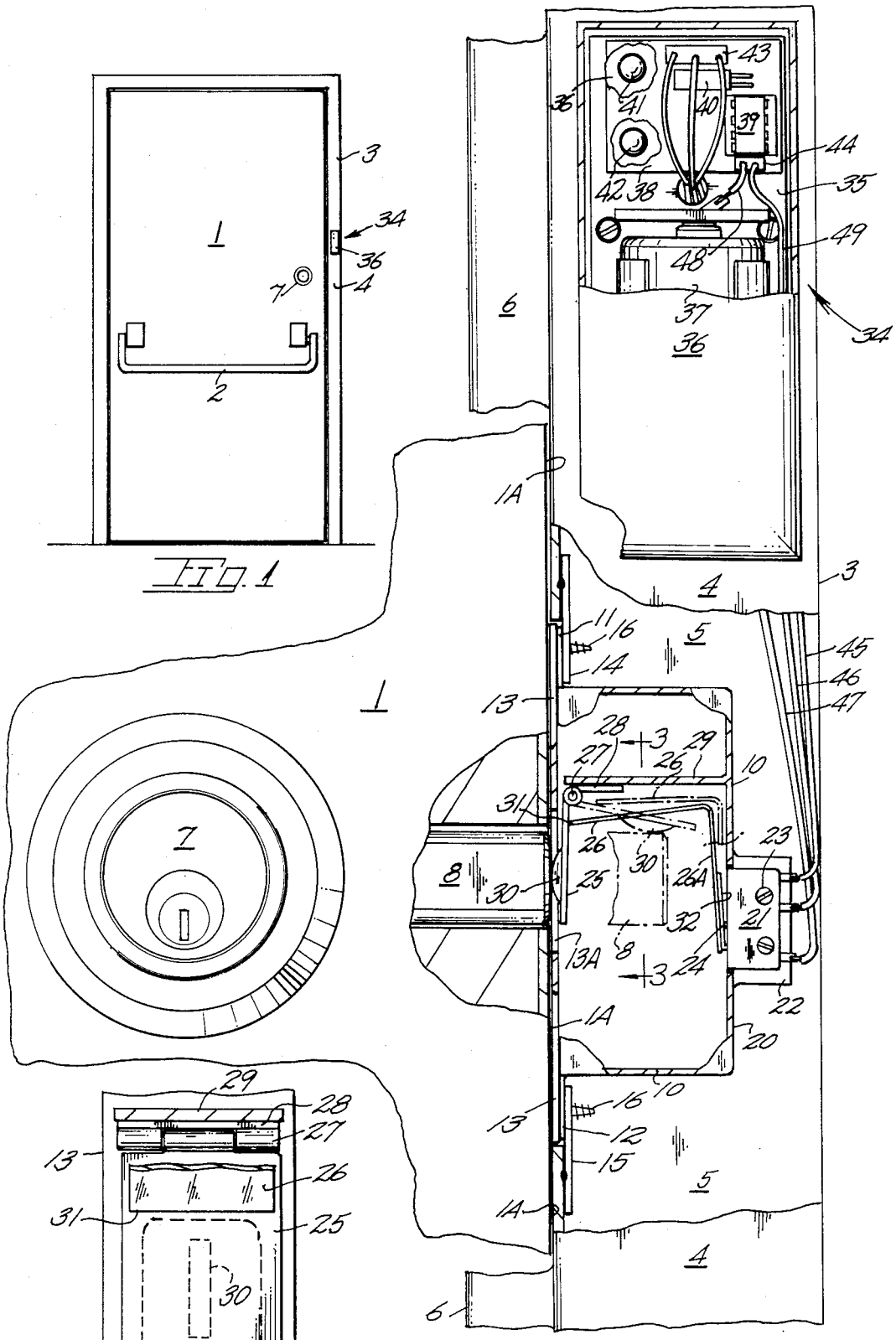
FIG. 2
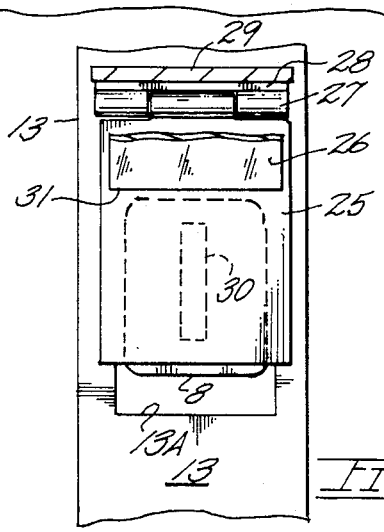
FIG. 3

INDICATOR SYSTEM FOR A DOOR WITH SLIDING BOLT LOCK

BACKGROUND OF THE PRESENT INVENTION

The present invention pertains generally to a system for indicating the locked-unlocked status of an exterior emergency or fire exit door.

Recognized building codes throughout the U.S., require that public buildings be provided with one or mor emergency exit doors which, by code, must remain unlocked when the building is accessible to the public. While such doors may include latches, they must be of the type released by one operation such as the actuation of a push bar. Such doors may be equipped with locks if the code requirement is satisfied that a visual indication is provided as to the locked-unlocked status of the door. Toward this end some building doors are equipped with mechanically actuated indicators which by nature are small and difficult to read from any distance. Such indicators are actuated by the bolt driving mechanism of the lock. Consideration has been given to enacting code requirements regarding electrical lock status indicators but heretofore such code requirements were not practical as suitable indicating systems and were not available to building owners.

A serious problem exists when existing switch arrangements are tried in door indicating systems. Erroneous indication of an emergency door status could result in loss of life and, at the least, a building code violation by the building owner.

The equipping of emergency doors with key operated locks is done to permit the building user to lock the door after public access has ended to permit the door from being used to provide entry and convenient egress to merchandise-laden burglars.

A switch sold by the Folger Adam Co., Model ASSW-104A termed a "keeper switch" provides a door frame mounted housing with a single switch lever protruding in the housing for actuation by a door bolt. Such a switch arrangement does not provide the necessary sensitivity to bolt movement.

SUMMARY OF THE PRESENT INVENTION

The present invention is embodied in a switch actuating mechanism particularly suited for use in a system providing an indication of the locked-unlocked status of a door.

A switch actuating mechanism is located within a wood or metal door frame and is actuated upon the position of the door lock bolt being altered. A first switch member of themechanism is senstive to initial bolt movement and results in an immediate indication upn the forward end of the bolt moving into the strike plate opening. Accordingly false indications as to door status are avoided. A second member of the mechanism is in yieldable abutment with the first member and serves to translate motion of the first member to switch actuating movement of the second member with both members moving simultaneously in response to bolt movement.

Visual indicators may be housed in a frame mounted unit which may also include a power source to provide a continuous display not affected by power losses. Circuity provided provides a visual display over an extended period before battery replacement is necessary.

Important objectives of the invention include the provision of a switch mechanism particularly sensitive to any movement of an actuating body such as a door lock bolt; the provision of a door status indicating system which avoids erroneous indications; the provision of a door status indicating system which permits the retrofitting of a building door frame in a convenient low-cost manner; the provision of a door status indicating system not susceptible to faulty installation; the provision of a door status indicator system which does not require periodic maintenance nor one which is dependent on an outside power source; the provision of a door status indicating system wherein switch actuating members are protected from foreign particles; the provision of mechanical switch actuating means particularly suited to detect any motion in a lock bolt and thence automatically positions itself out of the path of same so as to be compatible with bolts having different lengths of throw.

BRIEF DESCRIPTION OF THE DRAWINGS

In the drawings:

FIG. 1 is an elevational view of an emergency or fire exit door from a building interior;

FIG. 2 is a fragmentary elevational view of a door and door jamb with the present system in place thereon; and FIG. 3 is a vertical sectional view taken along line 3—3 of FIG. 2.

DETAILED DESCRIPTION OF THE PREFERRED EMBODIMENTS

With continuing attention to the drawings wherein applied reference numerals indicate parts similarly hereinafter identified and wherein reference numeral 1 is an exterior emergency exit door of the type required by various building codes to provide emergency egress from a public building. Such doors may include a latch or lock which is unlocked by a single action such as displacement of a puch bar 2 toward the door surface.

A door frame member at 3 in FIG. 2 has inner and outer walls (relative the building) 4 and 5. A jamb is at 6. A double cylinder dead bolt lock at 7 in key actuated from either side of the door to drive a bolt 8 outwardly or forwardly to a broken line position or retract same to the full line, door unlocking position.

A housing at 10 is provided with upper and lower flanges 11 and 12 which are preferably of a thin wall thickness to permit their installation between a strike plate 13 in a door frame opening and the tabs 14 and 15 conventionally provided on the door frame to receive strike plate fasteners 16. A strike plate opening is indicated at 13A. The tabs may be bent slightly inward if necessary to provide adequate clearance between the strike plate and the door edge 1A.

Housing 10 serves as a base for switch actuating means with a housing rear wall 20 serving to receive a switch 21 in place on a wall mounted flange 22 by fasteners 23. The switch is of the type having a button or pin 24 which requires but slight movement to reposition internal switch contacts. Such switches are well known in the electrical field. The switch is of the single pole double throw type.

Within the housing 10 are first and second switch actuating members 25 and 26. Said first switch actuating member 25 is movably supported inwardly of the strike plate 13 by a hinge 27 having a fixed portion 28. A housing wall 29 carries said hinge. The first member 25 is urged so as to rest against the strike plate and hence is positioned immediately forward of the retracted bolt 8 so as to be moved upon initial extension of the bolt. A projection at 30 may be located within the strike plate bolt opening 13A for this purpose.

Said second switch member 26 is also movable within said housing and includes a forward extremity 31 in sliding abutment with first member 25. The second switch member is generally of angular shape with a downwardly extending portion 26A supported by a switch lever 32 integral with lever switch 21 and acting on switch button 24. Switch member 26 is of a flexible nature to assure bolt and first switch member movement will be unobstructed. Switch lever 32 and member 26 may be one component.

An indicator unit is shown generally at 34 and is of a size to permit installation on door frame wall 4 adjacent lock 7. The unit includes a platform 35 suitably affixed to door fame wall 4 and carries a removable cover 36. A power source is shown as a one and one-half volt dry cell battery 37 in a circuit including a circuit board 38, an integrated circuit chip 39, a capacitor 40, red and green light emitting diodes 41 and 42 and sockets 43 and 44.

In use, any extension or forward movement of bolt 8 results in virtually immediate actuation of switch 21 to illuminate the red diode to provide a locked door indication whenever the end of bolt 8 has entered strike plate opening 13A. First switch member 25 is urged into resting engagement with the strike plate second switch member 26 which partakes of the outwardly biased nature of switch lever 32. Obviously, if so desired, hinge 27 could be of the spring loaded type. In a bolt retracted or door unlocked condition, a circuit is completed through a contact in switch 21 to green diode 42 as the switch members 25 and 26 assume the full line position of FIG. 2. Switch serving conductors at 45, 46 and 47 terminate at socket 43 while conductors 48 and 49 provide a power supply from battery 37. If desired, an alternate power source could be utilized with a back-up source such as a NI-CAD rechargeable battery. One embodiment of the system additionally includes a lever switch rated at 5 amps., an IC identified as LM 3909 and 100 Mf capacitor.

While I have shown but one embodiment of the invention, it will be apparent to those skilled in the art that the invention may be embodied still otherwise without departing from the spirit and scope of the invention.

Having thus described the invention, what is desired to be secured in a Letters Patent is:

I claim:

1. An indicator system for a door having a sliding bolt lock for travel into and out of a door frame, said system comprising, a housing for securement to the door frame and into which the sliding bolt may travel, said housing including flange means for attachment to the door frame, switch means carried by said housing and including a switch, a first switch member and a second member within said housing, hinge means on said housing supporting sad first switch member so as to locate same immediately forward of the sliding bolt when the bolt is retracted into the door, said first switch member inwardly displaceable upon initial entry of the bolt into the door frame opening, said second switch member displaceable by said first switch member upon said initial entry of the bolt into the door frame opening to actuate said switch, an indicator unit including signal means indicating the locked-unlocked status of the door, and means for electrically interconnecting said switch and said signal means.

2. The indicator system claimed in claim 1 wherein said flange means are flanges having a thin wall thickness and are thereby adapted for securement to a door frame between the door frame and a strike plate thereon in a retrofit manner.

3. The indicator system claimed in claim 2 wherein said first switch member includes a projection contacted by said bolt, said projection disposed normally in an opening in the strike plate.

4. The indicator system claimed in claim 3 wherein said first switch member is engageable with the strike plate.

5. The indicator system claimed in claim 1 wherein said first switch member and said second switch member are in sliding engagement with one another.

6. The indicator claimed in claim 1 wherein said second switch member is of right angular configuration and terminates at one end in sliding engagement with said first switch member.

7. The indicator claimed in claim 6 wherein said second switch member is yieldably carried by said switch.

8. The indicator claimed in claim 7 wherein said second switch member is of a flexible nature.

* * * * *